US010826224B2

(12) United States Patent
Uchiyama

(10) Patent No.: US 10,826,224 B2
(45) Date of Patent: Nov. 3, 2020

(54) ELASTIC MEMBER AND WATERPROOF CONNECTOR

(71) Applicant: Sumitomo Wiring Systems, Ltd., Yokkaichi, Mie (JP)

(72) Inventor: Yoshihiro Uchiyama, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 340 days.

(21) Appl. No.: 15/774,373

(22) PCT Filed: Oct. 28, 2016

(86) PCT No.: PCT/JP2016/081997
§ 371 (c)(1),
(2) Date: May 8, 2018

(87) PCT Pub. No.: WO2017/086122
PCT Pub. Date: May 26, 2017

(65) Prior Publication Data

US 2020/0251851 A1 Aug. 6, 2020

(30) Foreign Application Priority Data

Nov. 18, 2015 (JP) ..... 2015-225319

(51) Int. Cl.
*H01R 13/52* (2006.01)
*H01R 13/42* (2006.01)
*H01R 13/506* (2006.01)

(52) U.S. Cl.
CPC ..... *H01R 13/5208* (2013.01); *H01R 13/42* (2013.01); *H01R 13/506* (2013.01); *H01R 13/5216* (2013.01)

(58) Field of Classification Search
CPC ..... H01R 13/5205; H01R 13/5208; H01R 13/42; H01R 13/502
(Continued)

(56) References Cited

U.S. PATENT DOCUMENTS 6,520,788 B2 * 2/2003 Ichida ..... H01R 13/5219 439/271
7,371,115 B1 * 5/2008 Hsieh ..... H01R 13/5208 439/271
(Continued)

FOREIGN PATENT DOCUMENTS

EP 1059698 A2 * 12/2000 ..... H01R 13/5208
JP 3-43972 2/1991
(Continued)

OTHER PUBLICATIONS

European Search Report dated Sep. 5, 2018.
International Search Report dated Dec. 13, 2016.

*Primary Examiner* — Abdullah A Riyami
*Assistant Examiner* — Marcus E Harcum
(74) *Attorney, Agent, or Firm* — Gerald E. Hespos; Michael J. Porco; Matthew T. Hespos

(57) ABSTRACT

An elastic member and a waterproof connector are provided and are capable of maintaining water proofing properties even though a wire is shaken. The elastic member (20) is to be fit on a rear surface of a housing (10) capable of housing terminal metal pieces (T) fixed to end portions of wires (W). Seal holes (21) penetrate the elastic member (20) in forward and backward directions and are capable of being in tight contact with the wires (W). Lips (22) are formed to be aligned in the forward and backward directions in the seal holes (21). Grooves (30) open in the front surface and are formed around the seal holes (21). The grooves (30) have a depth enough to reach backward of the lip (22A) located on at least the front surface.

7 Claims, 4 Drawing Sheets

(58) Field of Classification Search
USPC ..... 439/587, 272, 275
See application file for complete search history.

(56) References Cited

U.S. PATENT DOCUMENTS

| | | | | |
|---|---|---|---|---|
| 9,178,301 | B2 * | 11/2015 | Shiga | H01R 13/5208 |
| 2002/0052142 | A1 | 5/2002 | Ishikawa et al. | |
| 2002/0187676 | A1 * | 12/2002 | Kurimoto | H01R 13/4362 439/595 |
| 2003/0087551 | A1 * | 5/2003 | Okayasu | H01R 13/4368 439/587 |
| 2004/0092163 | A1 * | 5/2004 | Nagayasu | H01R 13/5208 439/587 |
| 2005/0245130 | A1 | 11/2005 | Shiga et al. | |
| 2006/0040553 | A1 * | 2/2006 | Yamashita | H01R 13/5208 439/589 |
| 2010/0300748 | A1 * | 12/2010 | Matsuoka | H01R 13/5208 174/74 A |
| 2012/0009809 | A1 * | 1/2012 | Kataoka | H01R 13/521 439/271 |
| 2012/0129392 | A1 * | 5/2012 | Fujisaki | H01R 13/521 439/587 |
| 2012/0258623 | A1 * | 10/2012 | Nawa | H01R 13/562 439/587 |
| 2013/0052864 | A1 * | 2/2013 | Kataoka | H01R 13/5208 439/587 |
| 2014/0051276 | A1 * | 2/2014 | Itou | H01R 13/52 439/271 |
| 2014/0206222 | A1 * | 7/2014 | Hirano | H01R 13/62955 439/372 |
| 2014/0295708 | A1 * | 10/2014 | Omori | H01R 13/422 439/626 |
| 2016/0240957 | A1 * | 8/2016 | Ludwig | H01R 13/506 |

FOREIGN PATENT DOCUMENTS

| | | | |
|---|---|---|---|
| JP | 2002-141137 | 5/2002 | |
| JP | 2005-317385 | 11/2005 | |
| JP | 2015-35404 | 2/2015 | |
| JP | 2016143478 A * | 8/2016 | H01R 13/52 |
| WO | 9736346 A1 | 10/1997 | |

* cited by examiner

ELASTIC MEMBER AND WATERPROOF CONNECTOR

BACKGROUND

Field of the Invention

The invention relates to an elastic member and a waterproof connector.

Description of the Related Art

Japanese Unexamined Patent Publication No. 2015-35404 discloses a waterproof connector including an elastic member integrally sealing peripheries of wires. The waterproof connector includes a housing capable of housing terminal metal pieces fixed to the end portions of the wires. Seal holes penetrate the elastic member in the forward and backward directions and tightly contact the wires.

In the waterproof connector described above, when a wire drawn backward from the elastic member is bent, the seal hole cannot easily follow movement of the wire. For this reason, adhesiveness of the seal hole with respect to the wire is deteriorated when the wire is shaken to give rise to fears of deterioration of waterproof property.

The invention has been made on the basis of the above circumstances and has as its object to provide an elastic member and a waterproof connector capable of keeping waterproof property even though a wire is shaken.

SUMMARY

The invention relates to an elastic member fit on the rear surface of a housing that is capable of housing terminal metal pieces fixed to the end portions of wires. Seal holes penetrate the elastic member in the forward and backward directions and can tightly contact the wires. Lips are formed in the seal holes and are aligned in the forward and backward directions. Grooves are open in the front surface of the elastic member around each of the seal holes. Each groove has a depth to reach backward of the lip located on the front surface.

The elastic member may have outer peripheral rips aligned in the forward and backward directions and capable of being in tight contact with a fitting on which the elastic member is fit internally. Each groove has a depth to reach backward of at least the outer peripheral lip located on at least the front end. With the configuration described above, even though a thick wire is inserted into a seal hole, the outer peripheral lip located on at least the front end does not excessively press the fitting. When the outer peripheral lip excessively presses the fitting, the fitting may be deformed thermally in a high-pressure atmosphere. However, the invention prevents the fitting from being thermally deformed.

The rear end of the groove may be aligned with the front of the outer peripheral lip located on the rear end. With the above configuration, the outer peripheral lip located on at least the rear end is in tight contact with the inner peripheral surface of the fitting. Thus, the waterproof property of the elastic member can be secured sufficiently.

The invention also relates to a waterproof connector that includes the above-described elastic member and a housing capable of housing a plurality of terminal metal pieces fixed to the end portions of the wires. According to the invention, one partition divided by the groove on the elastic member moves to follow movement of a wire even though the wire is shaken a large amount. Thus, the lip located on the front end is hel tightly on the wire, and the elastic member is not deteriorated in waterproof property even though the wire is shaken.

DETAILED DESCRIPTION

An embodiment of the invention will be described below in detail with reference to FIGS. 1 to 4.

Figure 1:
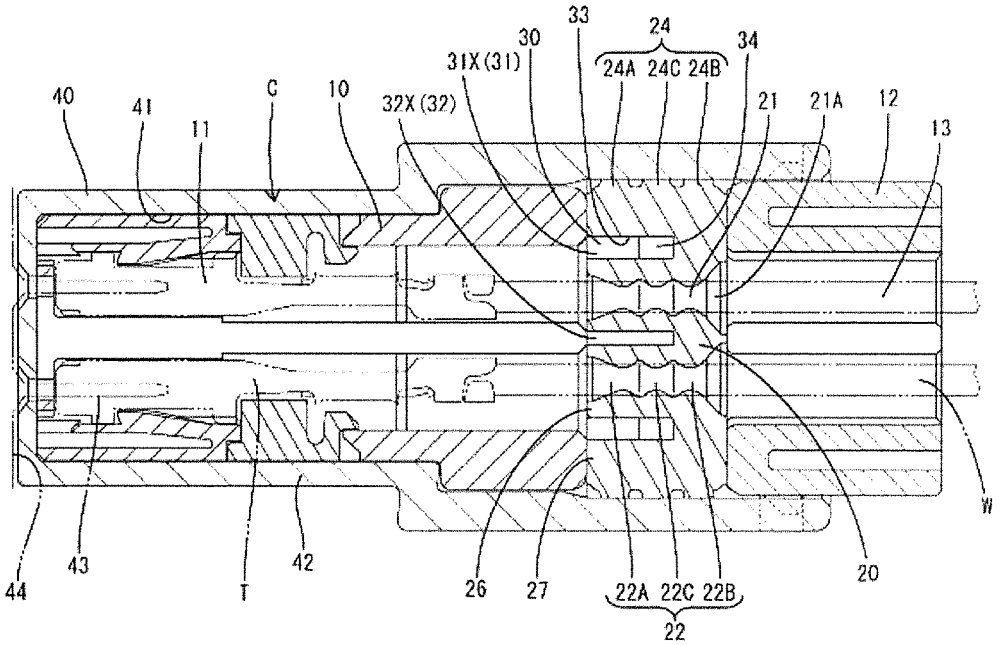
FIG. 1 is a sectional view showing a waterproof connector in a state in which an elastic member according to a first embodiment is fit.

A waterproof connector C according to the first embodiment includes a frame 40 made of a synthetic resin and a housing 10 fit on the frame 40. A plurality of housings 10 can be fit on the frame 40. A counterpart connector 44 is fit after all of the housings 10 are fit on the frame 40. In each constituent member, an explanation will be made on the assumption that a fitting surface (left side in FIG. 1) for the counterpart side is defined as the forward end, the opposite side is defined as the back end, and the upper and lower sides in FIG. 1 are defined as the upper and the lower sides, respectively.

The frame 40 has a square-box-like shape and includes fittings 41 on which the housings can be fit. Each of the fittings 41 is surrounded by a thin partition wall 42 and formed in a square-tubular shape long in width directions (lateral direction). The housings 10 are fit respectively on each of the fittings 41 from behind.

Each housing 10 is made of a synthetic resin and has a square block shape flat in the width direction. Cavities 11 are formed in the housing 10 and terminal metal pieces T fixed to the terminal portions of wires W are inserted into the cavities 11 from behind. The cavities 11 are arranged to be aligned in upper and lower levels.

The terminal metal pieces T are formed by bending metal plates, have connecting portions capable of being connected to counterpart terminal metal pieces 43 disposed on the counterpart connector 44, and are connected to the terminal portions of the wires W by pressure bonding.

An elastic member 20 is disposed on the rear surface of the housing 10 for integrally sealing the peripheries of the wires W. The elastic member 20 is made of rubber, such as silicon rubber, and has a flat mattress-like shape long in the width directions. The elastic member 20 is attached in tight contact with the rear surface of the housing 10. The elastic member 20 has a shape that is symmetrical in the vertical directions and the width directions.

Seal holes 21 penetrate the elastic member 20 in forward and backward directions and are capable of being in tight contact with the wires W. The seal holes 21 are disposed in two lines in accordance with the cavities 11, and coaxially communicate with the cavities 11, respectively, when the elastic member 20 is attached to the housing 10. All of the seal holes 21 have the same shapes. The seal holes 21 are arranged horizontally in the levels, and the seal hole 21 in the upper level and the seal hole 21 in the lower level are located at the same position in the width directions.

Each of the seal holes 21 has inner peripheral lips 22 arranged in the forward and backward directions. Each inner peripheral lip 22 projects inward and extends continuously over the circumference of the seal hole 21. The positions of projecting ends of the inner peripheral lips 22 in the radial direction of the seal hole 21 are almost equal to each other before the elastic member is assembled.

Front-end internal lips 22A are located at the front ends of all of the inner peripheral lips 22 and are inclined moderately to extend toward the front end of the seal hole 21. The position of the projecting end of the front-end internal lip 22A along the axial direction of the seal hole 21 is slightly closer to the rear than the center of the front-end internal lip 22A in the forward and backward directions.

The inner peripheral lips 22 include a rear-end internal lip 22B located on the rear end and a central internal lip 22C located at the center. The rear-end internal lip 22B and the central internal lip 22C have the same shapes.

A rear-end portion 21A of the seal hole 21 behind the rear-end internal lip 22B extends toward the rear end of the seal hole 21. The extending size of the rear end of the seal hole 21 is slightly larger than the extending size of the front end.

Grooves 30 are formed around the seal holes 21 and will be described in detail later.

Figure 2:
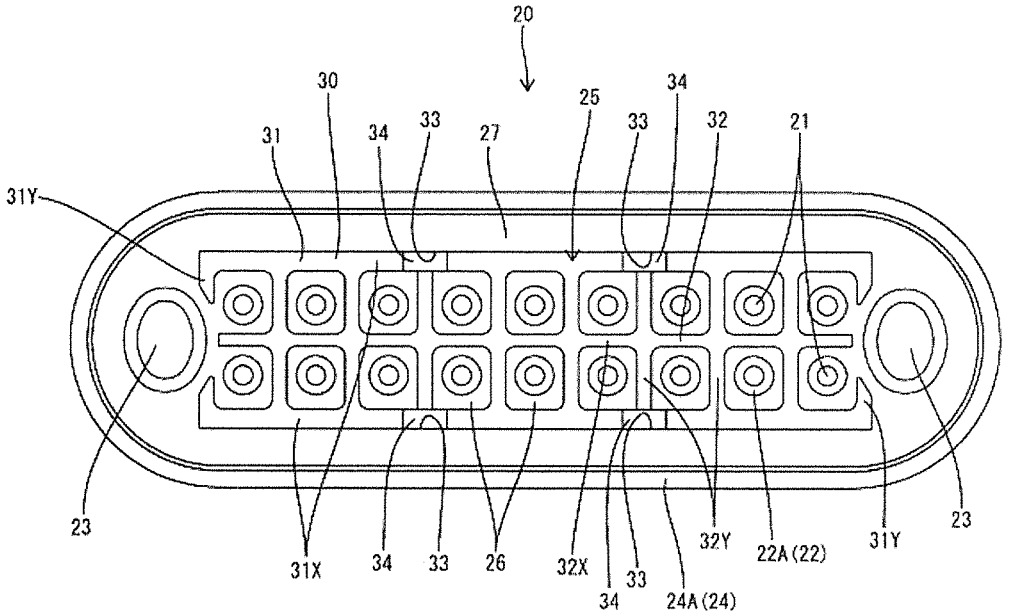
FIG. 2 is a front view showing the elastic member.

Through holes 23 penetrate the elastic member 20 and receive locking projections (not shown) disposed on a holder 12 (to be described later). The through holes 23, as shown in FIG. 2, are formed in each of the end portions of the elastic member 20 in the width directions. Each of the through holes 23 has an elliptic shape that is slightly long in the vertical directions.

Figure 3:
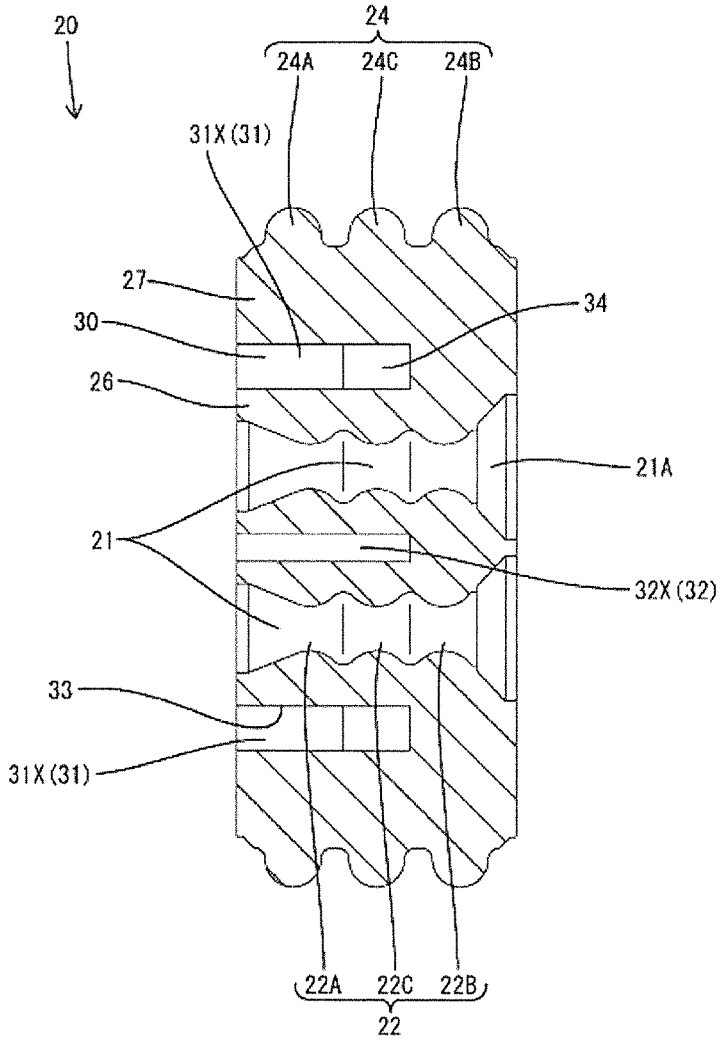
FIG. 3 is a sectional view showing the elastic member.

Outer peripheral lips 24 are formed on the outer peripheral surface of the elastic member 20 and are capable of being in tight contact with the inner peripheral surface of the fitting portion 41. The outer peripheral lips 24 are formed to be aligned in a line in the forward and backward directions. The number of outer peripheral lips 24 is equal to the number of inner peripheral lips 22. The outer peripheral lips 24 project out and extend continuously over the circumference of the elastic member 20. Each of the outer peripheral lips 24, as shown in FIG. 3, projects in a semicircular shape. All of the outer peripheral lips 24 have the same shape and, the projection ends of the outer peripheral lips 24 are at positions in the radial directions of the elastic member 20 almost equal to each other before the elastic member 20 is assembled.

All of the inner peripheral lips 22 and the outer peripheral lips 24 are located at positions almost equal to each other in the forward and backward directions, and the inner peripheral lips 22 and the outer peripheral lips 24 are wrapped with each other.

The outer peripheral lips 24 include a front-end external lip 24A that is closer to the front end than all of the other outer peripheral lips 24. The projecting ends of the front-end internal lips 22A are slightly more backward than the projecting ends of the front-end external lips 24A.

The outer peripheral lips 24 also include a rear-end external lip that is closer to the rear end than all of the other outer peripheral lips 24. The projecting ends of the rear-end internal lips 22B are more forward than the projecting end of the rear-end external lips 24B.

The outer peripheral lips 24 also include central external lips 24C. The central external lips 24C and the central internal lips 22C are located at the center of the elastic member 20 in the forward and backward directions, and the projection ends thereof are located at positions equal to each other without misalignment in the forward and backward directions.

A holder 12 made of a synthetic resin is attached on the rear surface of the elastic member 20. The holder 12 has a plate like shape long in the width directions, and through holes 13 penetrate the holder 12 in the forward and backward directions at positions corresponding to the seal holes 21 for receiving the terminal metal pieces. Locking projections (not shown) project forward at both ends of the holder 12 in the width direction and can penetrate the through holes 23 and lock on the housing 10.

Grooves are open in the front surface of the elastic member 20 and are formed around the seal holes 21. The grooves 30, as shown in FIG. 2, include an outer groove 31 integrally surrounding all of the seal holes 21 (to be referred to as seal hole group 25 hereinafter) and intermediate grooves 32 respectively dividing the seal holes 21. The outer groove 31 has a groove width slightly larger than that of the intermediate grooves 32. The grooves 30 are arranged symmetrically in the vertical directions and the width directions.

The grooves 30, on the front surface side of the elastic member 20, separate the peripheral edges 26 of the seal holes 21 from each other. More specifically, each outer groove 31 separates a part formed outside the outer grooves 31 (to be referred to as an outer frame portion 27 hereinafter) from the seal hole group 25, and the intermediate grooves 32 separate the seal holes 21 adjacent to each other in the vertical directions and the width directions from each other.

The outer grooves 31 are formed on both the upper and lower sides and both the left and right sides of the seal hole group 25.

Transverse outer grooves 31X are formed on both the upper and lower sides of the seal hole group 25 and extend narrowly in the width directions of the seal hole group 25. The transverse grooves 31X are formed continuously over the full width of the seal hole group 25. The upper and lower transverse grooves 31X are parallel to each other.

Vertical outer grooves 31Y are formed on both the left and right sides of the seal hole group 25 and extend from both end portions of the transverse grooves 31X to a position before the through hole 23. The vertical outer grooves 31Y are almost perpendicular to the transverse outer grooves 31X.

The intermediate grooves 32 are formed horizontally and vertically inside the outer groove 31.

The intermediate grooves 32 include transverse intermediate grooves 32X formed between the seal holes 21 that are adjacent to each other in the vertical direction and extend narrowly in the width directions of the seal hole group 25. The transverse intermediate grooves 32X are formed continuously over the full width of the seal hole group 25. The transverse intermediate groove 32X extends to a position before the through hole 23. The transverse intermediate grooves 32X are almost parallel to the upper and lower intermediate grooves 31X.

The intermediate grooves 32 also include vertical intermediate grooves 32Y that are formed between the seal holes 21 adjacent to each other in the width directions. The vertical intermediate grooves 32Y are almost perpendicular to the transverse intermediate grooves 32X. Both end portions of the vertical intermediate grooves 32Y in the vertical directions are connected to the transverse outer grooves 31X.

Each vertical intermediate groove 32Y has a groove width slightly larger than the groove width of the transverse intermediate groove 32X.

The grooves 30, as shown in FIG. 3, have a depth to reach backward of the front-end internal lip 22A and backward of the front-end external lip 24A, and the rear end of each groove 30 is located on the front sides of the rear-end internal lip 22B and the rear-end external lip 24B. More specifically, the rear end of each groove 30 is located in a dent between the central internal lip 22C and the rear-end internal lip 22B or a dent between the central external lip 24C and the rear-end external lip 24B.

A burying portion 34 is formed in each groove 30 and partially buries the rear end part of the groove 30 is formed. The burying portion 34 buries the groove 30 by amounts corresponding to the central internal lip 22C and the central external lip 24C.

Two burying portions 34, as shown in FIG. 2, are disposed on each of the upper and lower sides of the seal hole group 25. The burying portions 34 are arranged at positions symmetrical in the vertical directions and the width directions. Shallow grooves 33 are disposed at positions dividing the seal hole group 25 into three equal parts in the width directions. The burying portion 34 is disposed at a portion where the transverse outer groove 31X and the vertical intermediate groove 32Y cross. The burying portion 34 has a width larger than the groove width of the transverse intermediate groove 32Y in the width directions and is formed over the peripheral edge of the seal holes 21 adjacent to each other in the width directions. The burying portion 34 is connected to seal peripheral edges 26 adjacent to each other in the width directions and the outer frame 27.

A part in front of the burying portion 34 is the shallow groove portion 33 having a depth smaller than that of the other part. The shallow groove portion 33 becomes shallow by a depth corresponding to one of the inner peripheral lips 22 or the outer peripheral lips 24. More specifically, the rear end of the shallow groove portion 33 is located in a dent between the front-end internal lip 22A and the central internal lip 22C or a dent between the front-end external lip 24A and the central external lip 24C.

An example of an assembling operation of the waterproof connector C according to the first embodiment will be described below.

The elastic member 20 is attached on the rear surface of the housing 10. The locking projection of the holder 12 is caused to penetrate the through hole 23 to fit the elastic member 20 on the front surface side of the holder 12. Thereafter, the locking projection of the holder 12 locks on the housing 10 so that the elastic member 20 is attached in tight contact with the rear surface of the housing 10.

The terminal metal pieces T are inserted from the through hole 13 of the holder 12, through the seal hole 21 and into the cavities 11. When the terminal metal pieces T are inserted into the cavities 11, the inner peripheral lips 22 of the seal holes 21 are collapsed elastically to be in tight contact with the wires W, so that the seal holes 21 are sealed.

The housing on which the elastic member 20 is mounted is fit on the frame 40. When the housing 10 is fit on the fitting 41, the entire elastic member 20 and the front end of the holder 12 are fit internally on the fitting portion 41 and housed. At this time, the outer peripheral lip 24 of the elastic member 20 elastically collapses and then is brought into tight contact with the inner peripheral surface of the fitting 41 to seal the fitting 41.

Thus, the assembling operation of the waterproof connector C is completed.

An operation and an advantage of the embodiment configured as described above will be described below.

Figure 4:
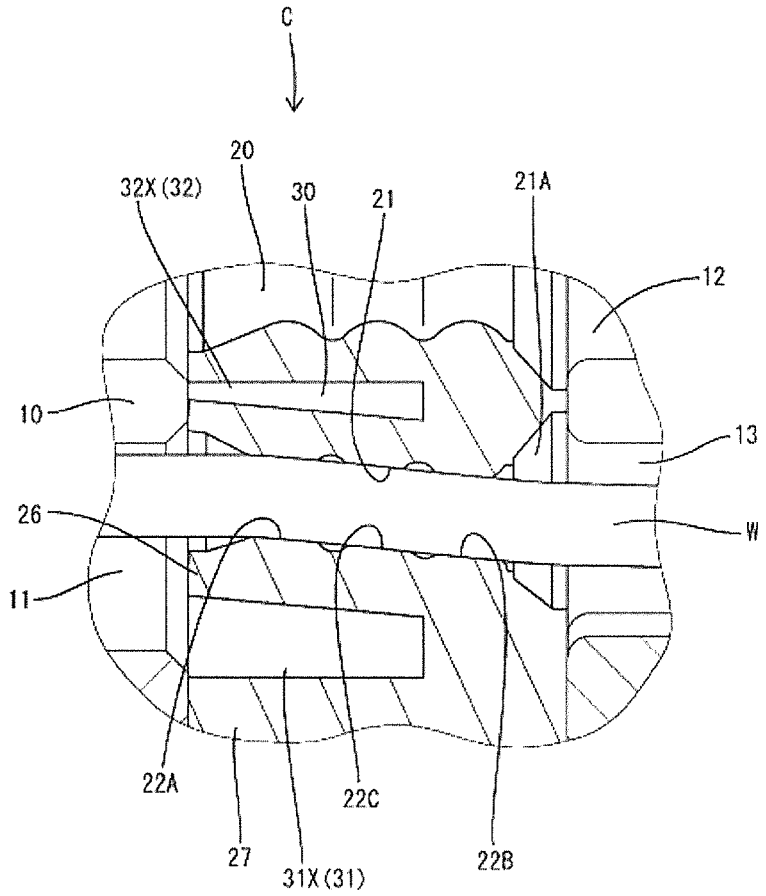
FIG. 4 is a partially enlarged view of a waterproof connector showing a manner in which a seal hole follows a wire.

In the elastic member 20 according to the embodiment, the seal holes 21 capable of being in tight contact with the wires W penetrate the elastic member 20 in the forward and backward directions. The inner peripheral lips 22 are formed in each of the seal holes 21 in a line in the forward and backward directions. The grooves 30 are formed around the seal holes 21 to have a depth to reach backward of the front-end internal lip 22A and forward of the central internal lip 22C. With this configuration, even though the wire W drawn backward from the insertion hole 13 of the holder 12 is shaken, as shown in FIG. 4, the inside part (seal peripheral edge 26) of the groove 30 follows the wire W, and the front-end internal lip 22A and the central internal lip 22C are kept in tight contact with the wire W. Thus, even though the wire W is shaken, the waterproof property can be kept.

The outer peripheral lips 24 capable of being in tight contact with the inner peripheral surface of the fitting 41 on which the elastic member 20 is fit internally are aligned in the forward and backward directions, and the grooves 30 have a depth to reach backward of the front-end external lip 24A and backward of the central external lip 24C. With this configuration, even though a thick wire W is inserted into the seal hole 21, the front-end external lip 24A and the central external lip 24C do not excessively press the fitting 41. Thus, in a high-pressure environment, the fitting 41 can be prevented from being thermally deformed by being pressed by the outer peripheral lips 24.

The rear end of the groove 30 is located on the rear-end internal lip 22B and on the front side of the rear-end external lip 24B. According to the configuration, since at least the rear-end external lip 24B is fixedly in tight contact with the inner peripheral surface of the fitting 41, the waterproof property can be secured sufficiently.

Second Embodiment

Figure 5:
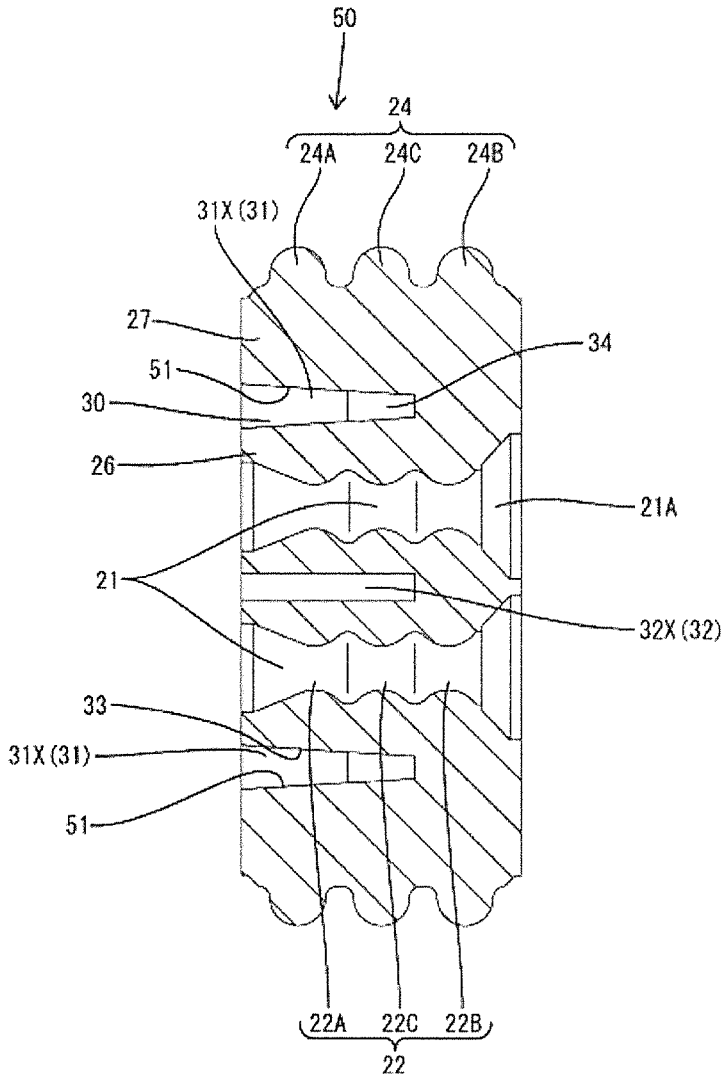
FIG. 5 is a sectional view showing an elastic member according to a second embodiment.

An elastic member 50 according to a second embodiment of the invention will be described below with reference to FIG. 5.

The elastic member 50 of the second embodiment is different from the first embodiment in that the groove portion 30 has a tapered portion 51. Configurations of the second embodiment that are the same as the first embodiment are denoted by the same reference numerals, but are not described again.

The elastic member 50 of the second embodiment, as in the first embodiment, have seal holes 21 capable of being in tight contact with the wires W. Three inner peripheral lips 22 are formed on each of the seal holes 21. The three outer peripheral lips 24 are formed on the outer peripheral surface of the elastic member 50, and the grooves 30 opening in the front surface are formed around the seal hole 21.

The tapered portion 51 is formed in the outer groove 31 and is inclined such that the width of the groove 30 in the vertical directions gradually decreases toward the rear. The tapered portion 51 is formed in the entire area of the outer groove 31 in the forward and backward directions. In this manner, the thicknesses of the outer frame 27 and the seal peripheral edge 26 gradually increase from the front end of the groove 30 toward the rear.

As described above, even though the wire W is shaken, the inside part of the groove 30 follows the wire W, and the inner peripheral lip 22 is kept in such a state as to be in tight contact with the wire W. For this reason, even though the wire W is shaken, the waterproof property can be kept. Since the thickness of the outer peripheral edge 27 gradually increases toward the rear, the embodiment is advantageous to keep the state in which the rear-end external lip 24B is in tight contact with the inner peripheral surface of the fitting portion 41.

The invention is not limited to the embodiments explained by the above description and the drawings. For example, the following embodiments are included in the scope of the invention.

The elastic members 20 (50) is fit internally on the fitting portion 41 of the frame 40 in the illustrated embodiment. However, the invention is not limited to this configuration, and a fitting portion on which an elastic member is fit internally may be a rubber stopper housing disposed on the rear end portion of a housing, or may be a hood or the like of a counterpart connector.

The three inner peripheral lips 22 and the three outer peripheral lips 24 are disclosed in the illustrated embodiment. However, the invention is not limited to this configuration, and the number of inner peripheral lips and the number of outer peripheral lips can be changed.

The rear end of the groove 30 is located in a dent between the central internal lip 22C and the rear-end internal lip 22B in the illustrated embodiment. However, the invention is not limited to this configuration, the rear end of the groove portion may be located at an arbitrary position which is behind the front-end internal lips.

The transverse outer groove 31X and the transverse intermediate groove 32X are continued over the entire width of the seal hole group 25 described above. However, the invention is not limited to this configuration, and the transverse outer groove and the transverse intermediate groove may be discontinuous in the width directions of the seal hole group.

The vertical intermediate groove 32Y of the groove 30 described above is connected to the transverse outer groove 31X. However, the invention is not limited to the configuration, and the vertical intermediate groove and the transverse intermediate groove need not be connected to each other.

Peripheral edges of the seal holes 21 described above are individually separated from each other. However, the invention is not limited to this configuration, and the peripheral edges of the seal holes may be separated from each other every two or more.

LIST OF REFERENCE SIGNS

C . . . Waterproof connector
T . . . Terminal petal piece
W . . . Wire nut
10 . . . Housing
20, 50 . . . Elastic member
21 . . . Seal hole
22 . . . Inner peripheral lip (lip)
22A . . . Front-end internal lip (lip located on the front end)
22B . . . Rear-end internal lip (lip located on the rear end)
24 . . . Outer peripheral lip
24A . . . Front-end external lip (outer peripheral lip located on the front end)
24B . . . Rear-end external lip (outer peripheral lip located on the rear end)
30 . . . Groove

The invention claimed is:

1. An elastic member having a front surface that is to be fit on a rear surface of a housing that can house terminal metal pieces fixed to end portions of wires, the elastic member further having a rear surface opposite the front surface, the front and rear surfaces of the elastic member being spaced apart in forward and backward directions, the elastic member comprising:

seal holes capable of being in tight contact with the wires and penetrating the elastic member in forward and backward directions;

inner lips formed in the seal holes and aligned in the forward and backward directions, the inner lips at each of the seal holes including a forward-most inner lip defining the inner lip of the respective seal hole that is closest to the front surface of the elastic member; and grooves opening in the front surface and formed at least partly around each of the seal holes and completely around a plurality of the seal holes, each of the grooves having a depth enough to reach backward of the forward-most inner lip.

2. The elastic member of claim 1, further comprising outer peripheral lips configured for tight contact with a fitting on which the elastic member is internally fit, the outer peripheral lips including a forward-most outer peripheral lip defining the outer peripheral lip that is closest to the front surface of the elastic member, and the groove have a depth to reach backward of the forward-most outer peripheral lip.

3. The elastic member of claim 2, wherein the outer peripheral lips including a rearward-most outer peripheral lip defining the outer peripheral lip that is closest to the rear surface of the elastic member and the rear end of the groove is located forward of the rearward-most outer peripheral lip.

4. A waterproof connector comprising;

the elastic member of claim 1; and a housing capable of housing terminal metal pieces fixed to the end portions of wires.

5. The elastic member of claim 1, wherein the seal holes comprise first and second rows of seal holes, the grooves comprise an intermediate groove extending between the first and second rows of seal holes along a width dimension defined by the first and second rows of seal holes.

6. The elastic member of claim 5, wherein the grooves further comprise first and second transverse outer grooves formed respectively on sides of the first and second rows of seal holes opposite the intermediate groove.

7. The elastic member of claim 6, wherein the grooves further comprise vertical grooves extending between the first and second transverse outer grooves and disposed respectively between adjacent seal holes in the first row of seal holes and between adjacent seal holes in the second row of seal holes.

* * * * *